US011014387B2

(12) United States Patent
Greger et al.

(10) Patent No.: US 11,014,387 B2
(45) Date of Patent: May 25, 2021

(54) METHOD AND DEVICE FOR AVOIDING CONTAMINATION OF A PRINTING PLATE GIVEN SURFACE-COVERING COATING OF A RECORDING MEDIUM WITH A COATING SUBSTANCE, AND CORRESPONDING PRINTING SYSTEM

(71) Applicant: Océ Holding B.V., Venlo (NL)

(72) Inventors: Oliver Greger, Munich (DE); Walter Brenner, Oberding (DE); Michael Pohlt, Munich (DE); Anna-Karin Eriksson, Poing (DE); Rainer Jaeger, Hallbergmoos (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/502,391

(22) Filed: Jul. 3, 2019

(65) Prior Publication Data

US 2020/0009882 A1 Jan. 9, 2020

(30) Foreign Application Priority Data

Jul. 4, 2018 (DE) ..... 10 2018 116 140.9

(51) Int. Cl.

| | |
|---|---|
| ***B41J 25/308*** | (2006.01) |
| ***B41J 11/00*** | (2006.01) |
| ***B41J 2/02*** | (2006.01) |

(52) U.S. Cl.

CPC ..... *B41J 25/308* (2013.01); *B41J 2/02* (2013.01); *B41J 11/0015* (2013.01)

(58) Field of Classification Search

CPC ..... B41J 11/0015; B41J 25/308; B41J 2/02

See application file for complete search history.

(56) References Cited

U.S. PATENT DOCUMENTS

| | | | |
|---|---|---|---|
| 4,411,706 | A | 10/1983 | Wallace et al. |
| 6,283,589 | B1 | 9/2001 | Gelbart |

(Continued)

FOREIGN PATENT DOCUMENTS

| | | | |
|---|---|---|---|
| DE | 60303072 | T2 | 8/2006 |
| WO | 2014084787 | A1 | 6/2014 |

OTHER PUBLICATIONS

German Action dated Feb. 13, 2019 for foreign application No. 10 2018 116 140.9.

*Primary Examiner* — Geoffrey S Mruk

(74) *Attorney, Agent, or Firm* — Schiff Hardin LLP

(57) ABSTRACT

The disclosure relates to a method for avoiding contamination of a printing plate given surface-covering coating of a dust-forming recording medium (e.g. an uncoated paper) with a coating substance (e.g. a primer) in an inkjet printing operation. The method can include feeding the recording medium at a feed velocity that is greater than 20 meters per minute; continuously printing of the coating substance onto the recording medium by at least one print head including a plurality of print nozzles, the coating substance being printed at a constant, predetermined applied quantity per area. A nip between the print head and the recording medium is provided such that a fluid-dynamic eddy is created between the recording medium and the print head and/or the printing plate. The disclosure also related to a printing system that is configured to implement the method.

17 Claims, 3 Drawing Sheets

(56) References Cited

U.S. PATENT DOCUMENTS

| | | | | |
|---|---|---|---|---|
| 7,354,145 | B2 | 4/2008 | Nito et al. | |
| 8,596,742 | B2 * | 12/2013 | Leoni | B41J 11/005 347/16 |
| 9,862,215 | B2 * | 1/2018 | Miller | B41J 29/377 |
| 2008/0180502 | A1 | 7/2008 | Tran et al. | |
| 2013/0335494 | A1 | 12/2013 | Chen-Chien et al. | |
| 2015/0091974 | A1 * | 4/2015 | Aoyama | C09D 11/54 347/21 |
| 2016/0159110 | A1 | 6/2016 | Beier et al. | |
| 2017/0028758 | A1 | 2/2017 | Satou et al. | |

* cited by examiner

METHOD AND DEVICE FOR AVOIDING CONTAMINATION OF A PRINTING PLATE GIVEN SURFACE-COVERING COATING OF A RECORDING MEDIUM WITH A COATING SUBSTANCE, AND CORRESPONDING PRINTING SYSTEM

CROSS REFERENCE TO RELATED APPLICATIONS

This patent application claims priority to German Patent Application No. 102018116140.9, filed Jul. 4, 2018, which is incorporated herein by reference in its entirety.

BACKGROUND

Field

The disclosure relates to: a method for avoiding contamination of a printing plate given surface-covering coating of a recording medium with a coating substance (e.g. a primer); a device for avoiding contamination of a printing plate given surface-covering coating of a recording medium with a coating substance (e.g. a primer); and a printing system for coating a recording medium with a coating substance, such as a primer.

Related Art

Given surface-covering inkjet printing to dust-forming substrates such as a recording medium, for example uncoated papers, deposits of soil particles—for example paper dust and fibers—may occur on the nozzle plate of the print head over the printing time period. This type of contamination is especially common given full-surface primer printing by means of an inkjet print head.

Deposits on the printing plate represent a seed for droplet formation, and thus a cause of nozzle failures of a primer print head. Degradations of the final print quality of the later print image may therefore be incurred, for example due to bleeding colors in the following color printing, non-uniform drying of the color ink, or the like. Therefore, cleaning systems, for example web cleaning systems based on air flow, are sometimes used to clean the paper web, often in advance of a primer inkjet station, in order to remove loose paper dust from the substrate before printing. However, a quite complicated additional cleaning device is disadvantageously required for this.

U.S. Pat. No. 4,411,706 A also describes a concept for targeted eddy generation around the print nozzles by means of compressed air, with which dust particles should be kept away from the openings. An additional compressed air supply and suitable nozzle and guidance elements are required for this. High dynamics of the air within the air gap are thus also generated.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
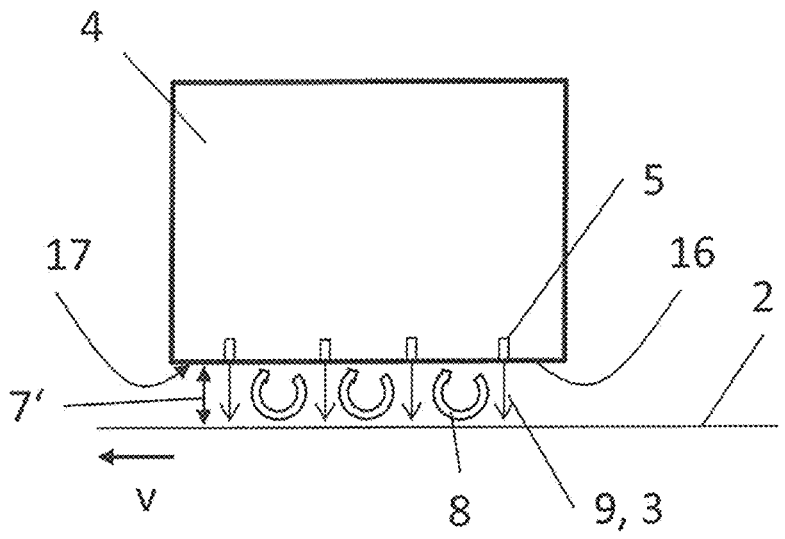
FIG. 1 is a schematic illustration of a printing to a recording medium with a coating substance.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to provide an improved method and a corresponding device for avoiding contamination of a printing plate given surface-covering coating of a recording medium with a coating substance.

Although the disclosure as well as its underlying problem are explained using a primer print head, the disclosure is, however, not limited to primer application, but rather can also be transferred to, for example, full-surface color printing, including insofar as this is performed without primer, for example in one color. Furthermore, an application for a coating after the color separation, for example with a finish varnish, would also be conceivable.

The disclosure relates to a method for avoiding contamination of a printing plate given surface-covering coating of a recording medium with a coating substance, in particular an uncoated paper, with a coating substance (e.g. a primer), in an inkjet printing method. In this example, a feed velocity of the recording medium can be greater than 20 meters per minute; a nip between print head and recording medium can be significantly enlarged in comparison to a conventional printing to the recording medium; and a predetermined applied quantity of the coating substance per area can be constantly printed onto the recording medium.

The disclosure also relates to a device for avoiding contamination of a printing plate upon coating a dust-forming recording medium, in particular an uncoated paper, with a coating substance (e.g. a primer), in an inkjet printing method, with: a print head which has a plurality of print nozzles, wherein a nip between print head and recording medium is provided that is significantly enlarged in comparison to a conventional printing with a print image; and a controller for activation of print nozzles, where the controller is fashioned and designed to activate the print nozzles for surface-covering printing of the coating substance onto the recording medium, in particular according to a method according to the disclosure, such that a predetermined applied quantity of the coating substance per area can be constantly printed onto the recording medium.

The disclosure additionally relates to a printing system for coating a recording medium with a coating substance (e.g. primer), having: a transport device which is designed for continuous transport of the recording medium with a feed velocity of greater than 20 meters per minute; and a primer inkjet station for continuous printing to the recording medium with a predetermined applied quantity of primer per area, where the primer inkjet station has a device according to the disclosure and/or is designed to implement a method according to the disclosure.

The applicant has realized that given a continuous printing process with constant nozzle activity, in particular at high feed velocities of greater than 20 meters per minute, eddies in the nip between recording medium and print head or printing plate arise as a result of fluid dynamics, due to the nearly stationary print jet and possibly the feed. These eddies may transport soil particles and dust from the recording medium to the printing plate if the recording medium is dusty or itself gives off dust. This is especially relevant given printing to uncoated papers, which give off dust quite strongly—for example in comparison to coated papers—in the dry state, meaning before the application of a coating substance.

A further realization is that a coating substance, in particular a primer, may be applied onto a recording medium with a distinctly lower print quality than a conventional print image. In contrast to color inks, a coating substance may particularly also be statistically distributed, and possibly may also bleed, without this having a negative effect on the print quality of the print image printed later. The coating depends predominantly on the surface coverage, which is achieved even with lower print quality upon coating.

Exemplary embodiments produce a reduction of deposits on the printing plate by avoiding air eddies (vortices) by implementing a stark enlargement of the nip between print head and recording medium, which would lead to an unacceptable print quality in a conventional printing, but is harmless for the coating substance, which is normally invisible in a final print image. That is, the Applicant has recognized that the relationship between the nip and print quality can be exploited during the printing of a coating substance (e.g. primer) to reduce or avoid the creation of eddies without affecting the overall print quality. In this way, air eddies induced by the ink jets, and possibly due to the feed velocity of the recording medium, do not arrive at the printing plate, or arrive only to a negligible degree, without additional devices being necessary for this. Fewer particles accordingly arrive at the nozzle plate.

In an exemplary embodiment, this principle is provided at a primer bar for preparatory coating of the recording medium with a primer. Given a subsequent printing to the recording medium with a print image, in particular at following color bars, the nip may then be regularly set back to a predetermined nominal value so that a high print quality is achieved for the final print image.

In an exemplary embodiment, a dusting or contamination of the nozzle plate given surface-covering printing of the coating substance is thus reduced by enlarging the nip, which prevents nozzle failures and thus ensures the desired print quality in the long term.

In an exemplary embodiment, the formation of eddies may also additionally be avoided or reduced in that the number of print nozzles that are simultaneously active in surface-covering printing is reduced, and the nozzles to be activated are alternated, whereby fewer stationary conditions appear in the nip. In order to nevertheless achieve the desired applied quantity per area for the surface-covering printing of the coating substance, which is also referred to as a surface coverage, an enlargement of the droplets emitted by the print nozzles may preferably be provided that is likewise harmless given a coating substance.

In an exemplary embodiment, a surface-covering coating or printing relates to a predetermined area of the recording medium and the area is entirely printed to with the coating substance. For example, it may thereby be an entire printing region of the recording medium (full area), where smaller predetermined (partial) surfaces or segments of the printing region may also be provided, however, for example across the width of a print head or a print head segment.

One or more aspects, embodiments, and/or developments of the present disclosure can be combined as would be understood by one of ordinary skill in the relevant arts. In particular, all features of the method for printing to a recording medium with a coating substance are transferable to a device for printing to a recording medium with a coating substance, and to a corresponding printing system, and vice versa.

Additional possible embodiments, developments, and implementations of the disclosure also encompass combinations of features of the disclosure described in the preceding or in the following with regard to the exemplary embodiments.

FIG. 1 shows a schematic depiction of a process for printing to a recording medium 2 with a coating substance 3.

It involves an inkjet printing process for which an inkjet print head 4 is used. The recording medium 2 is, for example, an uncoated paper which is comparably dusty, in particular as a result of loose fibers located therein.

The print head 4 has a plurality of print nozzles 5 which are provided in a nozzle plate 16 arranged on the underside 17 of the print head 4. The underside 17 of the print head 4 may thereby represent a nozzle plate 16. Here, four individual print nozzles 5 are depicted in a purely schematic manner, wherein a print head 4 normally actually has a very high number of print nozzles 5. The diameter of apertures of the print nozzles may be in a range from 5 μm to 50 μm, for example.

A recording medium 2 travels along below the nozzle plate or the print nozzles 5 with a constant feed velocity v greater than 20 meters per minute, with a predetermined nip 7' that corresponds to a nominal value necessary for a high print quality. The print nozzles 5 may thereby be continuously active. Coating substance 3 is typically printed on with a smallest possible droplet size, which typically may be present given a volume of approximately 3 pl.

The coating substance 3 is a fluid for coating the recording medium. The coating substance can be a primer that prevents a bleeding of color inks printed thereafter.

The number of active nozzles conforms to the desired applied quantity per area on the recording medium, which is also referred to as a surface coverage.

In the depicted embodiment, 100% of the schematically depicted four nozzles are continuously active in order to print the desired applied quantity per area, for example 0.4 to 2.3 $g/m^2$, onto the recording medium for a surface-covering coating given the set smallest possible droplet size. Of course, other predetermined applied quantities, for example in a range between 0.1 and 4.8 g/m$^2$, are also conceivable depending on the type and composition of the recording medium.

With different settings, such a print head 4 may apply an identical applied quantity of fluid with similar application density (fluid quantity per area). For example, this may be achieved with different droplet sizes and a different number or distribution of active print nozzles. In practice, a smallest possible droplet size is normally chosen in order to always keep a largest possible number of print nozzles constantly active, and thus in order to avoid a clogging of the print nozzles and/or a streaking of the application.

According to fluid dynamics according to Bernoulli and Venturi, the jets 9 of coating substance 3 streaming from the print nozzles 5, as well as the feed of the recording medium 2, also accelerate the surrounding air. In this way, a certain air flow arises along the jets 9, wherein it leads to an eddy formation in the nip 7', in particular upon the jets 9 striking the recording medium 2. In FIG. 1, this is schematically illustrated with corresponding turning arrows that symbolize the eddies 8. A stationary vortex may even develop. This means that the vortex may propagate across the entire width of the recording medium 2 (see FIG. 5, from Page 18 *a* to Page 18 *b*).

Such eddies 8 are capable of swirling the dust and/or soil particles up from the recording medium 2 and transporting them onto the printing plate 16 or to the print nozzles 5. Deposits thus form there which in turn represent a seed for droplet formation, and thus a cause of nozzle failures of the print head 4.

Figure 2:
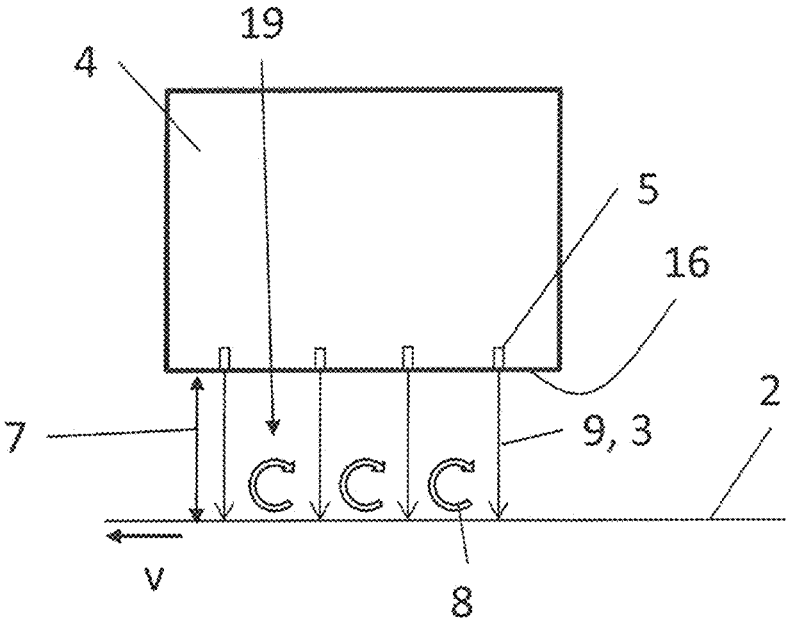
FIG. 2 is a schematic illustration of a printing to a recording medium with a coating substance according to an exemplary embodiment.

FIG. 2 shows a schematic depiction of a printing to a recording medium according to an exemplary embodiment.

In contrast to the process described with reference to FIG. 1, here the nip 7 has been enlarged.

The process according to the disclosure for avoiding contamination of a printing plate 16 given surface-covering coating of a dust-forming recording medium 2 is suitable for uncoated papers, but is not limited thereto. In an exemplary embodiment, a coating substance 3, such as a primer, is applied in the inkjet printing process without contaminating the printing plate 16.

In an exemplary embodiment, the feed velocity of the recording medium is more than 20 meters per minute, where a nip 7 between print head 4 and recording medium is starkly enlarged in comparison to a printing to the recording medium 2 (see 7', FIG. 1). Although here a predetermined applied quantity per area of the coating substance 3 is constantly printed onto the recording medium 2, a contamination of the printing plate 16 is avoided in this way.

In this embodiment, the eddies 8 initiated by the ink jets 9 and the feed of the recording medium 2 are far enough removed from the printing plate 16 to generate a sufficient suction back in the direction of the recording medium 2. This suction advantageously restrains the whirled-up dust/soil. Due to the enlarged nip, whirled-up dust or soil particles predominantly remain in the eddy system induced by the process itself, and/or are sufficiently strongly restrained by gravity, without arriving at the printing plate 16. A manner of self-regulation to restrain the dust/soil may advantageously occur in this way without additional cleaning measures being necessary.

In an exemplary embodiment, the nip 7 between print head 4 and recording medium 2 is chosen to be so large that, or is to be enlarged such that, the printing plate 16 is located outside of a zone of influence 19 of the eddies 8 formed in the nip 7. Dust located in the eddy system is thus largely held within the zone of influence and does not deposit on the printing plate 16.

In an exemplary embodiment, the nip 7 provided between print head 4 and recording medium 2 is enlarged by at least half in comparison to printing with a print image as illustrated in FIG. 1. In an exemplary embodiment, the provided nip 7 is at least doubled than that shown in FIG. 1. In an exemplary embodiment, the provided nip 7 is enlarged (e.g. at least doubled) in comparison to conventional nip sizes (e.g. nip 7' as shown in FIG. 1) used for printing with a print image, where the conventional nip sizes are understood by one of ordinary skill in the art. In an exemplary embodiment, the enlargement relates to a process-specific nominal value of the nip 7 for printing with high print quality. Depending on droplet size, a distinct deviation of the impact point of the individual droplets is thus to be assumed, which given a regular print image would lead to a blurring, and thus to an unacceptable print quality. However, a sharpness of the applied print image is not decisive for the application of a coating substance, for example a primer, which is not visibly differentiated in the later print image. In an exemplary embodiment, a surface-covering application is especially be generated anyway. In an exemplary embodiment, the impact on print quality of certain deviations of the impact points of individual droplets are thus harmless for the application of the coating substance, in particular insofar as these deviations are systematically or statistically distributed.

In an exemplary embodiment, an enlarged nip 7 for the application of the coating substance 3 may also amount to a multiple of the nip 7' required for printing of a conventional print image (with the desired print quality). In an exemplary embodiment, in comparison to the conventional printing with a print image, the nip 7 is provided between two and three times the conventional nip 7'. In an exemplary embodiment, the nip 7 amounts to between 2.4 and 2.6 times the conventional nip 7'. In the depicted embodiment, the nip 7 amounts to 2.5 times the conventional nip 7', for example. The ratio of the enlarged nip 7 to the conventional nip 7' is not limited to the exemplary values described herein, and can be selected such that the printing plate 16 is located outside of a zone of influence 19 of the eddies 8 formed in the nip 7. Dust located in the eddy system is thus largely held within the zone of influence and does not deposit on the printing plate 16.

For high capacity inkjet printing methods for printing to the recording medium 2 with a print image, a conventional nip 7' or its nominal value is typically in a range from approximately 1 mm+/−0.5 mm. In the example illustrated in FIG. 2, the regular nip 7' is 1.2 mm.

In an exemplary embodiment, a significantly enlarged nip 7 for the coating of the recording medium 2 with a coating substance 3 is accordingly provided to be greater than or equal to 1.8 mm, for example. In an exemplary embodiment, the enlarged nip 7 is between, for example, 2.4 mm and 3.6 mm. In the depicted embodiment shown in FIG. 2, the nip 7 is, for example, at 3 mm and amounts to 2.5 times the conventional nip 7'.

Figure 3:
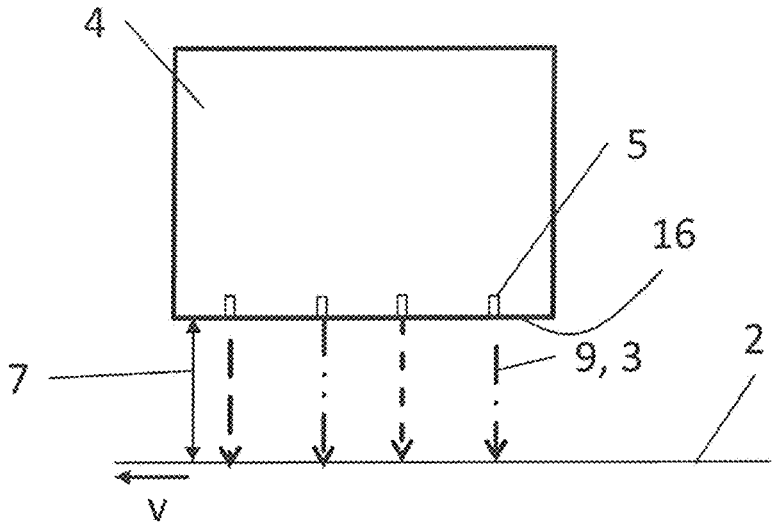
FIG. 3 is a schematic illustration of a printing to a recording medium with a coating substance according to an exemplary embodiment.

FIG. 3 shows a schematic depiction of a method for printing to a recording medium according to an exemplary embodiment.

In an exemplary embodiment, in addition to an enlarged nip 7, here the effect of the eddy formation between the printing plate 16 and the recording medium 2 is further reduced or avoided by an alternation of active print nozzles. For this, the print nozzles can be activated individually. In an exemplary embodiment, all print nozzles 5 are thus never simultaneously active. In an exemplary embodiment, a larger droplet size in comparison to FIG. 1 is also provided. In particular, a portion of the theoretically possible parameter field of the print head is thus truncated. For example, a portion that has more than 80% nozzle activity and also has a portion of the smallest droplet size. In an exemplary embodiment, a largest available droplet size is particularly used so that an optimally small portion of the print nozzles 5 is simultaneously active, and thus a maximum alternation of active print nozzles can be set.

In an exemplary embodiment, the alternation of the print nozzles 5 is controlled statistically or stochastically, for example. Unwanted patterns, for example Moiré effects, may advantageously be avoided in this way. The alternation is symbolized in FIG. 3 with the different interrupted jets 9 of the coating substance 3. Here it is apparent that all print nozzles 5 are never simultaneously active. Rather, as an example only 50% of the print nozzles 5 are active.

In an exemplary embodiment, for printing to the recording medium 2 with the coating substance 3 (e.g. a primer), on the one hand the nip 7 is enlarged (as compared to nip 7'), and on the other hand a plurality of print nozzles 5 of the print head 4 are activated in alternation for continuous printing of the coating substance 3 onto the recording medium 2, where only a portion of the print nozzles 5 of the print head 4 are ever simultaneously activated. In this example, a predetermined applied quantity of the coating substance 3 per area can constantly be printed in a surface-covering manner onto the recording medium 2. For example, the coating substance is thus applied in a surface-covering manner at least across the width of a print head. In an exemplary embodiment, the coating substance 3 is printed onto the full area of the recording medium 2 (i.e. across its entire printing region 6) or a defined portion of the printing region 6 of the recording medium 2.

In an exemplary embodiment, a grid of active print nozzles 5 of the print head 4 is varied continuously to alternate the active print nozzles 5. The variation of the raster of active print nozzles 5 may in particular be controlled statistically.

In an exemplary embodiment, a fraction of simultaneously activated print nozzles 5 of the print head 4 is at most 80%, at most 75%, or at most 50%.

In an exemplary embodiment, a droplet size output by the print nozzles 5 for printing of the coating substance 3 is consequently provided, or dimensioned or set, to be larger than given a full-surface printing with the same applied quantity per area and continuously active print nozzles 5 (as in FIG. 1). This is symbolized in FIG. 3 by the thicker (in comparison to FIG. 1) stroke width of the jets 9.

In an exemplary embodiment, a droplet size output by the print nozzles 5 for printing of the coating substance 3 with the predetermined applied quantity per area is dimensioned such that at most 80%, in particular at most 75%, preferably at most 50% of the print nozzles 5 of the print head 4 is simultaneously required for printing of the predetermined applied quantity per area. The droplets are thus markedly larger than would actually be necessary for printing of the predetermined applied quantity per area. Less simultaneous activity of the print nozzles is required with the comparably large droplet size, such that the activity may be alternated better or more.

The strength of the eddy 8 forming in the nip is also dependent on, among other things, the fraction of the simultaneously active print nozzles 5 that are in use. The more print nozzles 5 that are simultaneously active or "jetting", the more that local conditions arise in which eddies 8 are created. An increase of the droplet size may therefore additionally lower the fraction of simultaneously active print nozzles, because fewer simultaneously active print nozzles are therefore needed to provide the desired applied quantity. With fewer simultaneously active print nozzles, a more versatile alternation of active print nozzles is in turn enabled, which additionally contributes to transient flow conditions, and thus to the prevention of eddies.

In addition to the enlarged clearance (i.e. nip 7) between recording medium 2 and printing plate 16, the strength of the eddies 8 are also markedly weaker than for continuously or uniformly active print nozzles 5. Advantageously, even fewer soil or dust particles accordingly arrive at the nozzle plate 16, such that again fewer deposits form there.

Figure 4:
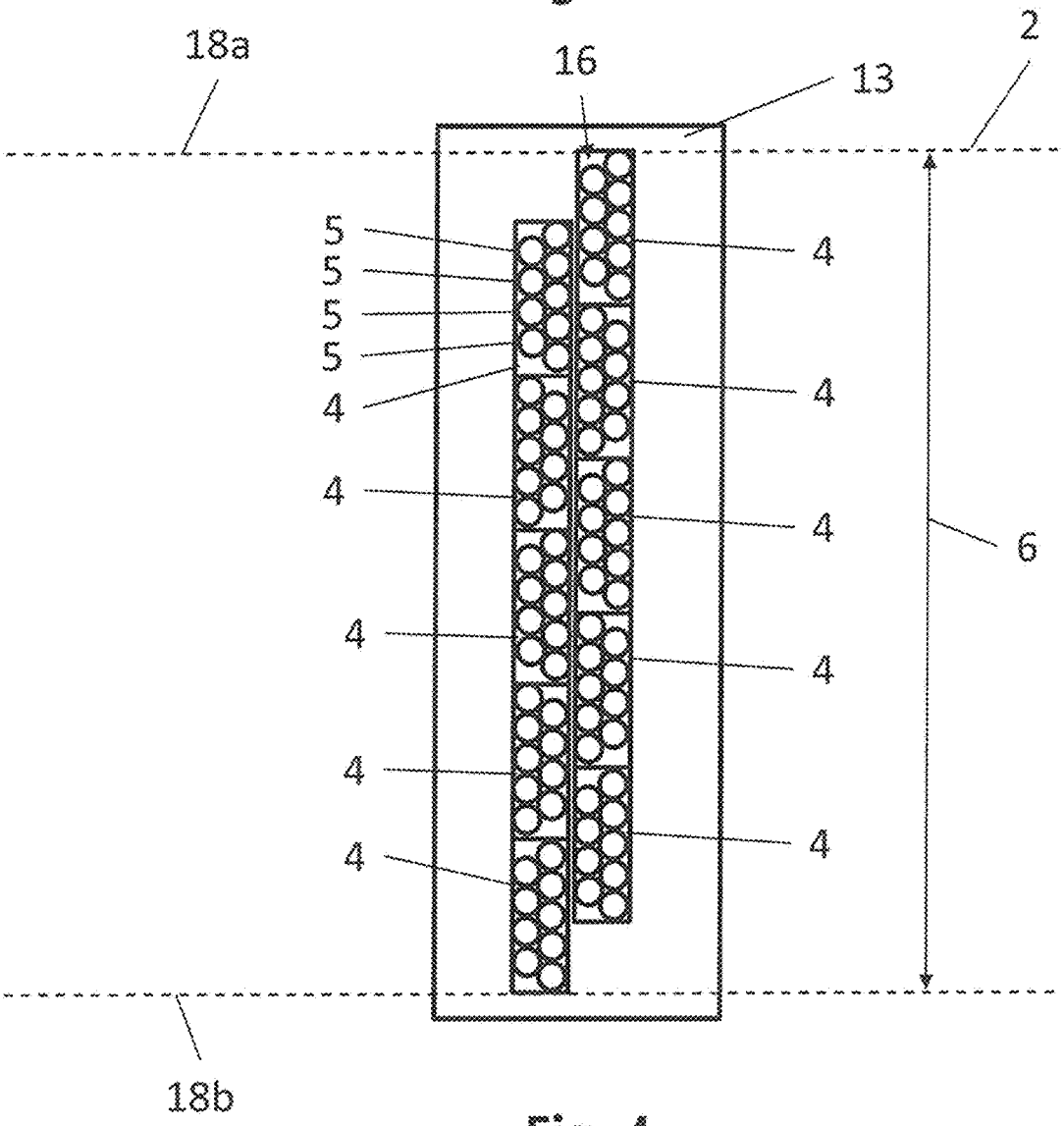
FIG. 4 is a schematic illustration of a nozzle plate side of a primer inkjet printing station according to an exemplary embodiment.

FIG. 4 shows a schematic depiction of a nozzle plate side of a primer inkjet printing station 13 according to an exemplary embodiment.

In an exemplary embodiment, the primer inkjet printing station 13 has a plurality of print heads 4 arranged side by side, in particular a plurality of offset rows of print heads 4 arranged side by side. The print nozzles 5 of the print heads 4 are designed to be activatable by a controller 11 (see FIG. 5) to output a coating substance.

Purely by way of example here, the primer inkjet printing station 13, which is also referred to as a primer print bar, has two rows of print heads 4 arranged side by side. The two rows are arranged offset relative to one another. In this way, it is ensured that a streak-free, surface-covering printing over the entire width (represented here as an arrow) of the printing region 6 of the recording medium 2 (symbolized with dashed lines) is enabled.

Of course, the number of print heads 4 may vary depending on size and depending on width of a recording medium 2 or its printing region 6. It would also be conceivable to provide only a single print head 4 with the necessary width, or to design the primer inkjet station 13 with a single print head 4 extending over the entire width of the printing region 6.

Each of the depicted print heads 4 has a plurality of print nozzles 5. For this, in an exemplary embodiment, each print head 4 has what is known as a printing plate 16, into which are integrated the print nozzles 4 in the form of microscopic openings.

Purely for the sake of an improved clarity, only nine print nozzles 5 are shown at each of the print heads 4 in the depiction of FIG. 3, and the print nozzles 5 are arranged in two rows side by side and offset from one another. In an actual print head, a number of print nozzles 5 are generally larger and the print nozzles 5 have much smaller dimensions in comparison to the size of the print head, for example in the micrometer range. The most varied arrangements of the print nozzles are thereby possible. The dimensions, as well as the number and type of the arrangement of the print nozzles 5, can be varied in versatile ways. In an exemplary embodiment, a conventional inkjet print head can be used for the primer inkjet station 13 insofar as the print nozzles 5 can be individually activated.

A clearance (e.g. pitch) of the print nozzles 5 relative to one another depends on the type of print heads 4 that are used, which print heads 4 in turn determine the resolution that can be printed with the primer inkjet station 13.

In an exemplary embodiment, the primer inkjet station 2 is configured with a resolution of 600 dpi (dots per inch). This corresponds to a clearance of two print nozzles of approximately 42.3 μm. Of course, the print nozzle clearance can be varied or scaled depending on the desired resolution.

In FIG. 4, a position of a recording medium 2 is symbolized with dashed lines, the width of which recording medium 2 between the two sides 18*a*, 18*b* represents a printing region 6. The printing region 6 is entirely covered by the arrangement of the print heads 4 of the primer inkjet station 13. In this way, the recording medium 2 may be coated with the coating substance 3 over its entire area, in a surface-covering manner, via inkjet printing.

Of course, partial surface-covering coatings of the recording medium 2, i.e. not covering the entire area but rather only partial areas, would also be conceivable. For example, a coating that is therefore applied may also extend only across the width of individual or multiple print heads and/or segments of individual print heads.

Figure 5:
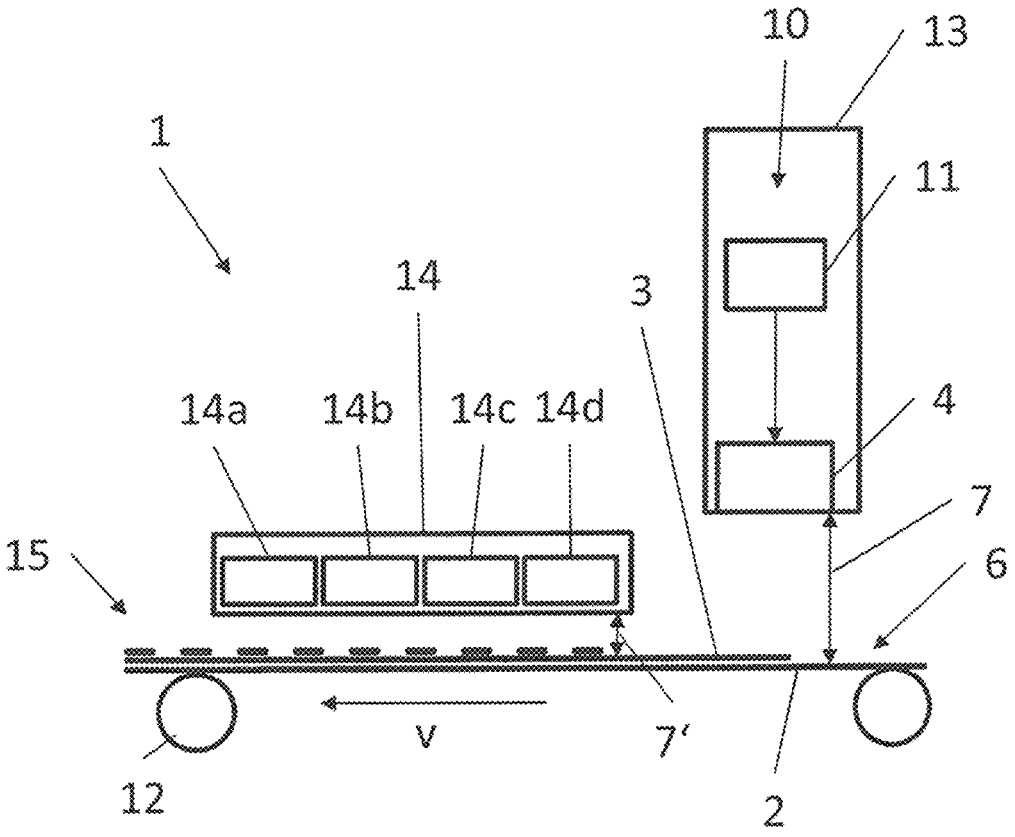
FIG. 5 is a schematic illustration of a printing system according to an exemplary embodiment.

FIG. 5 shows a schematic depiction of a printing system 1 according to an exemplary embodiment.

In an exemplary embodiment, the printing system 1 is configured to avoid contamination of a printing plate 16 upon surface-covering printing to an uncoated paper as a recording medium 2, with a primer as a coating substance 3. In the depicted embodiment, the printing system 1 is also additionally provided for subsequent printing with a color print whose quality should be ensured by the primer application.

In an exemplary embodiment, the printing system 1 includes a transport device 12 for continuous transport of the recording medium 2 with a predetermined feed velocity v which, for what is known as high capacity printing, is above 20 meters per minute. In this way, the recording medium 2 is initially transported to a primer inkjet station 13 for continuous printing to the recording medium 2 with a predetermined applied quantity of the primer 3 per area.

In an exemplary embodiment, for printing to the recording medium 2 with the coating substance 3, the primer inkjet station 13 includes a printer 10 that contains at least one print head 4 which has a plurality of activatable print nozzles 4, and includes a controller 11 configured to activate the print nozzles 5. Of course, still further elements may be provided, in particular additional print heads, for example as in the primer inkjet station 13 according to FIG. 3. The primer inkjet station 13 may in particular be designed with an arrangement of print heads as described with regard to FIG. 4.

A nip 7 between the recording medium 2 and the nozzle plate 16 of the print head 4 is provided starkly enlarged in comparison to a conventional printing (e.g. nip 7') to the recording medium 2 with a print image 15, where all size ratios and dimensions of the nip 7 that are described in detail in relation to FIG. 2 may be provided. For example, here the starkly enlarged nip is 3 mm.

Following the primer inkjet station 13, the recording medium 2 is conveyed to an inkjet color printing station 14, for example a conventional YMCK station with four of what are known as color bars 14*a*, 14*b*, 14*c*, 14*d*, to produce the active print image 15. Such a color printing station is fundamentally known to the person skilled in the art, which is why its mode of operation is not discussed in detail at this point. At the inkjet color printing station 14, a conventional nip 7' is set which is necessary to produce a print quality sufficient for the print image 15. For example, here the conventional nip is 1.2 mm.

In an exemplary embodiment, the controller 11 is configured to activate the print nozzles 5, in the manner explained with regard to FIG. 1 through 3, for surface-covering printing of the coating substance 3 onto the recording medium 2. The activation is thus provided such that a predetermined applied quantity per area of the coating substance 3 can be constantly printed onto the recording medium 2. In an exemplary embodiment, the controller 11 includes processor circuitry that is configured to activate the print nozzles 5. In an exemplary embodiment, the controller 11 can be provided in the printing system 1 but not integrated in the printer 10. The controller 11 can be configured to control one or more printers 10 in the printing system 1 (e.g. one controller 11 can control two or more printers 10 in embodiments having two or more printers 10). In another aspect, each printer 10 can have a corresponding controller 11. In an exemplary embodiment, the controller 11 is configured to adjust the position of the inkjet stations 13 and/or 14 relative to the recording medium 2 to provide an adjustable nip. For example, the controller 11 can adjust the position of the primer inkjet printing station 13 to the increased nip 7 for application of the coating substance 3. In an exemplary aspect, the controller 11 can adjust the position of the inkjet stations 13 and/or 14 to adjust the nip based on printing conditions, including the transport velocity v, one or more characteristics of the recording medium 2 (e.g. its susceptibility to contaminate the nozzle plate), one or more printing parameters, one or more characteristics of the droplet size and/or quantity, and/or one or more other printing and/or environmental characteristics as would be understood by one of ordinary skill in the art. In another embodiment, the primer inkjet station 13 has a fixed position so that the nip 7 between the recording medium 2 and the nozzle plate 16 is fixed and/or the inkjet color printing station 14 has a fixed position with a reduced nip 7' between the inkjet color printing station 14 and the recording medium 2.

In an exemplary embodiment, the print nozzles 5 are activated in alternation, as explained with regard to FIG. 3, so that only a portion of the print nozzles 5 can ever be simultaneously activated.

According to the disclosure, a contamination of the printing plate 16 is thus advantageously avoided (or at least reduced), and thus the number of nozzle failures is reduced, via arrangements of the print head 4 with an enlarged nip 7 according exemplary embodiments.

Although the present disclosure has been completely described in the preceding using preferred exemplary embodiments, it is not limited thereto, but rather can be modified in numerous ways.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, a programmable processing circuit, other structural electronic hardware, or a combination thereof. A processor includes a microprocessor, a digital signal processor (DSP), central processor (CPU), application-specific instruction set processor (ASIP), graphics and/or image processor, multicore processor, or other hardware processor. The processor may be "hard-coded" with instructions to perform corresponding function(s) according to aspects described herein.

Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 printing system
2 recording medium
3 coating substance
4 print head
5 print nozzle
6 printing region
7 nip
8 eddy
9 jet
10 printer
11 controller
12 transport device
13 primer inkjet station
14 inkjet color printing station
14*a* print bar
14*b* print bar
14*c* print bar
14*d* print bar
15 print image
16 printing plate
17 underside
18*a* side
18*b* side
19 zone of influence
v feed velocity

The invention claimed is:

1. A method for avoiding contamination of a printing plate during printing of a coating substance to a recording medium, the method comprising:

feeding the recording medium at a feed velocity that is greater than 20 meters per minute; and continuously printing of the coating substance onto the recording medium by at least one print head including a plurality of print nozzles, the coating substance being printed at a constant, predetermined applied quantity per area, wherein a nip between the print head and the recording medium is increased such that: a fluid-dynamic eddy is created between the recording medium and the print head and/or the printing plate, and the printing plate is located outside of a zone of influence of the fluid-dynamic eddy formed in the nip.

2. The method according to claim 1, wherein the nip between print head and recording medium is increased by at least 50% of a conventional nip of a conventional printing with a print image.

3. The method according to claim 1, wherein the nip is between 2.4 and 2.6 times larger in comparison to a conventional nip of a conventional printing with a print image.

4. The Method according to claim 1, wherein the nip is at least 1.8 mm.

5. The Method according to claim 1, wherein the nip is between 2.4 and 3.6 mm.

6. The Method according to claim 1, wherein the nip is between 2.8 and 3.2 mm.

7. The Method according to claim 1, wherein the nip is 3 mm.

8. The method according to claim 1, wherein the coating substance is applied in a surface-covering manner at least across a width of a print head.

9. The method according to claim 1, wherein the coating substance is printed onto a full area of the recording medium and/or a printing region of the recording medium.

10. The method according to claim 1, wherein the recording medium is uncoated paper.

11. The method according to claim 10, wherein the printing of the coating substance to the recording medium is a surface-covering coating of the recording medium.

12. The method according to claim 1, wherein the coating substance is a primer.

13. The method according to claim 1, wherein the nip is configured to reduce or prevent debris from the recording medium from reaching the printing plate during the printing of the coating substance, the debris being forced from the recording medium by the printing of the coating substance onto the recording medium or by the feed velocity of the recording medium.

14. A non-transitory computer-readable storage medium with an executable program stored thereon, wherein, when executed, the program instructs a processor to perform the method of claim 1.

15. A printing system adapted to avoid contamination from the coating substance applied in an inkjet printing operation to the recording medium, the system comprising:

the print head including the printing plate and the plurality of print nozzles; and a controller configured to perform the method of claim 1.

16. A printing system adapted to avoid contamination from a coating substance applied in an inkjet printing operation to a recording medium, the apparatus comprising:

a print head including a printing plate and a plurality of print nozzles, wherein a nip between printing plate of the print head and the recording medium is enlarged compared to a nip of a conventional printing of a print image such that the printing plate is located outside of a zone of influence of a fluid-dynamic eddy formed in the nip; and a controller configured to:

control the printing system to feed the recording medium at a feed velocity; and activate the print nozzles to surface-cover print the coating substance onto the recording medium, wherein a predetermined applied quantity per area of the coating substance is printed onto the recording medium.

17. The printing system according to claim 16, wherein the nip is configured to reduce or prevent debris from the recording medium from reaching the printing plate during the printing of the coating substance, the debris being forced from the recording medium by the printing of the coating substance onto the recording medium or by the feed velocity of the recording medium.

* * * * *